United States Patent [19]

Rigsby

[11] Patent Number: 4,763,582

[45] Date of Patent: Aug. 16, 1988

[54] MULTIPURPOSE FURNITURE ASSEMBLY

[76] Inventor: Joseph C. Rigsby, 10995 SW. 173rd Ter., Miami, Fla. 33157

[21] Appl. No.: 1,391

[22] Filed: Jan. 8, 1987

[51] Int. Cl.[4] ..... A47B 11/00

[52] U.S. Cl. ..... 108/103; 108/94

[58] Field of Search ..... 108/103, 139, 101, 102, 108/106, 107, 108, 110, 111, 142, 149, 150, 90–97

[56] References Cited

U.S. PATENT DOCUMENTS

| | | | |
|---|---|---|---|
| 100,073 | 2/1870 | Robertson | 108/103 |
| 101,799 | 4/1870 | Wilder | 108/103 |
| 554,661 | 2/1896 | Doolittle | 108/95 X |
| 613,985 | 11/1898 | Gadbury | 108/103 |
| 1,576,716 | 3/1926 | Casgrain | 108/94 X |
| 3,468,428 | 9/1969 | Reibold | 108/103 X |
| 3,538,862 | 11/1970 | Patriarca | 108/94 X |
| 3,543,699 | 12/1970 | Leikarts | 108/103 X |
| 3,648,627 | 3/1972 | Schliemann et al. | 108/111 |
| 3,648,892 | 3/1972 | Morgan | 108/95 X |
| 4,086,857 | 5/1978 | Igarashi et al. | 108/106 |

FOREIGN PATENT DOCUMENTS

| | | | |
|---|---|---|---|
| 520335 | 1/1956 | Canada | 108/103 |
| 357049 | 8/1922 | Fed. Rep. of Germany | 108/103 |
| 2256629 | 7/1975 | France | 108/103 |
| 2416669 | 10/1979 | France | 108/103 |

*Primary Examiner*—Kenneth J. Dorner
*Assistant Examiner*—José V. Chen
*Attorney, Agent, or Firm*—John Cyril Malloy

[57] ABSTRACT

An assembly of furniture comprising an upstanding base including at least one and preferably a plurality of stanchions to which at least one or a plurality of support platforms are pivotally attached wherein the support platforms are structured to have fixedly secured thereto horizontally oriented panel members themselves structured to be supporting surfaces for serving, eating, display, etc. The support platforms and panel members mounted thereon are selectively movable about the longitudinal axis of the respective stanchion to which they are attached. The support platforms, panel members thereon, and stanchions are cooperatively positioned such that support surfaces are provided at various levels and adjustably positioned at such levels to vary the geometric configuration of the furniture assembly which would result in varying the quantity of floor space (or other horizontal surface) required for its usage.

8 Claims, 5 Drawing Sheets

MULTIPURPOSE FURNITURE ASSEMBLY

BACKGROUND OF THE INVENTION

1. Field of the Invention

This invention relates to a furniture structure or assembly capable of a wide variety of uses and being of a contemporary structural configuration allowing for numerous horizontal surfaces in the form of supporting panel members to be selectively disposed into numerous positions so as to vary the function and appearance of the subject furniture assembly which will result in varying the functional purpose of the space it serves.

2. Description of the Prior Art

The use of furniture by modern day man of course has existed for many years. The design, shape, aesthetic appearance, configuration and dimensional characteristics of furniture vary almost as much as the personalities of the users of such furniture. While existing furniture may be broadly classified into numerous categories such as chairs, tables, shelving, etc., the design and structural features of individual items in each of these categories also may vary greatly while at the same time having common structural components.

Furniture structures or assemblies generally relating to shelving or tables or more broadly, the presentation of horizontal support surfaces have enjoyed wide popularity for generations. Such structures are somewhat similar in that they present multiple horizontally oriented surfaces dimensioned and disposed to perform numerous functions. Such functions include display surfaces, functional support surfaces, eating and/or serving surfaces. One common problem or feature inherent in most prior art devices is a lack of flexibility or the inability of such common, prior art furniture structures to function as a multipurpose unit or allow the space which they serve to use for a variety of multipurpose functions.

Certain attempts have been made in the prior art to alter or vary the purpose for which a particular furniture structure is designed in order to add more versatility and functionality to the furniture piece. Such prior art attempts include but are not limited to the structures disclosed in the U.S. Pat. Nos. 3,468,428 to Reibold; 3,543,699 to Leikarts; 3,897,063 to Lehwalder and 3,538,862 to Patriarca. While the structures disclosed in the aforementioned patents are considered to be operational for their intended purpose, such structures may still be considered somewhat limiting in their versatility and aesthetic appearance.

Accordingly, there is a need in the furniture industry for a contemporary assembly capable of performing a multipurpose function having the overall versatility of adding to the appearance of a room or area in which it is positioned while at the same time allow the space in which it is positioned to serve many functional purposes.

SUMMARY OF THE INVENTION

The present invention relates to a multipurpose furniture construction capable of presenting for a variety of uses, a plurality of horizontal surfaces which may be used for serving, display, eating, etc., and further wherein the plurality of surfaces in the form of supporting panel members are arranged at a variety of heights along an upstanding base means of the subject furniture assembly.

More specifically, the base means of the present invention is designed to have one end positioned for mounting on a supporting surface, such as flooring or the like. The base means further includes at least one, or in one embodiment a plurality of upstanding stanchions disposed in spaced relation to one another wherein each of the stanchions utilized includes in an elongated configuration. Each of the stanchions include at least one, but in some embodiments a plurality of support platforms pivotaly secured thereto and extending outwardly therefrom. Hinge and/or mounting structures associated with each of the platforms allow the selective movement or positioning of the platforms in a pivotal or rotational manner relative to the longitudinal axis of the particular stanchion to which they are attached. In embodiments where a plurality of such platforms are utilized or secured to the same stanchion, such platforms are of course pivotaly secured at different heights along the length of the stanchion this enables each of the support platforms to be movable relative to one another about a common axis of rotation (the longitudinal axis of the respective stanchion to which they are attached). A given support platform is also movable relative to any one of the plurality of support platforms secured to the same or other adjacently positioned stanchions.

Each of the support platforms includes at least one support arm formed thereon and extending outwardly from the particular stanchion to which the respective support platform is attached. One such embodiment of the present invention incldues a support platform with a plurality of support arms. These support arms are each structured for the support and fixed attachment to a horizontally oriented panel member. Each of the panel members may define a horizontal support surface which may be used for a number of purposes. Further, since each of the panel members are fixedly secured to the respective arms and, since each of the arms are fixedly secured to the respective support platforms, the panel members on different support platforms may be selectively moveable relative to one another. In one embodiment of the present invention, to be described in greater detail hereinafter, platforms on adjacently positioned stanchions are cooperatively configured and disposed such that respective panel members supported thereon may be selectively positionable into and out of aligned, coplanar engagement with one another so as to form an enlarged panel assembly. Such panel assembly may again be usable for a variety of purposes as desired.

Other structural features of the present invention include the possibility of forming a plurality of support arms on each or preferred ones of the support platforms thereby increasing the versatility of not only individual support platforms, but of the entire furniture. Each of the platforms are moveable relative to adjacent platforms on the same stanchion as well as spaced apart platforms on adjacently positioned stanchions. Also, the specific configuration of the support platform defining the structure and disposition of one or more support arms on each such support platform may vary greatly thereby enabling versatility in the aesthetic appearance of the overall structure while rendering such structure capable for use for a variety of functions.

The invention accordingly comprises the features of construction, a combination of elements and arrangement of parts which will be exemplified in the construction hereinafter set forth, and the scope of the invention wil be indicated in the claims.

BRIEF DESCRIPTION OF THE DRAWINGS

For a full understanding of the nature of the present invention, reference should be had to the following detailed description taken in connection with the accompanying drawings in which.

Like references are used to refer to like parts throughout the use of the drawings.

DESCRIPTION OF PREFERRED EMBODIMENT

Figure 22:
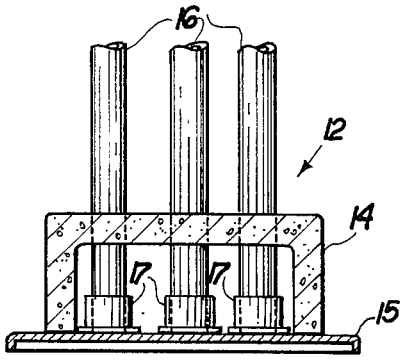
FIG. 22 is a sectional view in partial cutaway along line 22—22 of FIG. 21.
Figure 23:
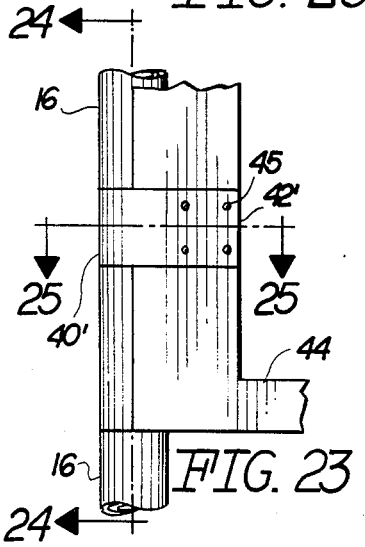
FIG. 23 is a detailed sectional view in partial cutaway along line 23—23 of FIG. 25.
Figure 24:
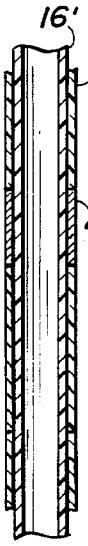
FIG. 24 is a longitudinal sectional view in partial cutaway along line 24—24 of FIG. 25.
Figure 26:
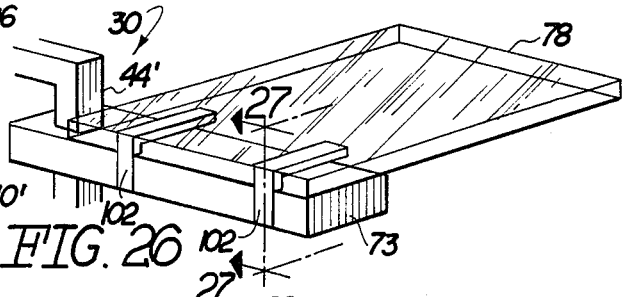
FIG. 26 is a perspective view in partial cutaway of a panel member mounted on an arm of a support platform in one embodiment of the present invention.
Figure 27:
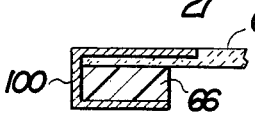
FIG. 27 is a sectional view in partial cutaway along line 27—27 of FIG. 26.
Figure 28:
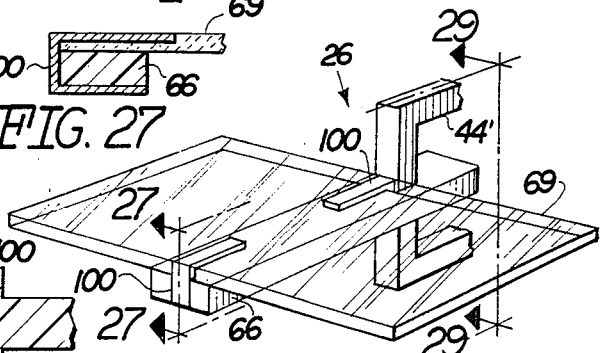
FIG. 28 is a perspective view in partial cutaway of another embodiment of a panel member mounted on a support arm of a support arm of the present invention.
Figure 25:
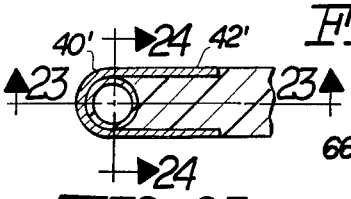
FIG. 25 is a sectional view in partial cutaway along line 25—25 of FIG. 23.
Figure 29:
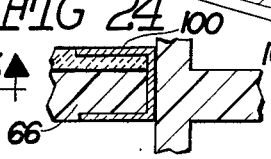
FIG. 29 is a sectional view in partial cutaway along line 29—29 of FIG. 28.

The present invention relates to a furniture assembly generally indicated as 10 and including a base means generally indicated as 12 having an anchoring portion 14 designed and dimensioned to rest on a supporting surface such as a flooring or the like. The base means 12 further includes a plurality of upstanding stanchions 16 each having an elongated configuration and then being disposed in spaced apart, preferably parallel relation to one another. The stanchions 16 are secured to the anchor portion 14 (see FIG. 22) wherein a substantially heavy and/or high strength material forms the major portion of the anchor 14. An outwardly extending skirt 15 may be secured to the lower end of the anchor 14. The plurality of stanchions 16 pass through preformed or structured apertures dimensioned to receive the stanchion 16 so as to be anchored by means of sockets 17 to the interior of the anchor 14. It should be emphasized that the anchoring portion 14 and 15 may be separate from or in fact a part of the supporting surface such as the flooring within the room of a building structure. Accordingly, it is contemplated within the present invention that one or a plurality of the stanchions may in fact be secured directly to the flooring or other supporting surface rather than interconnected to a separate and independent anchoring portion 14 as being part of the base 12.

Figure 1:
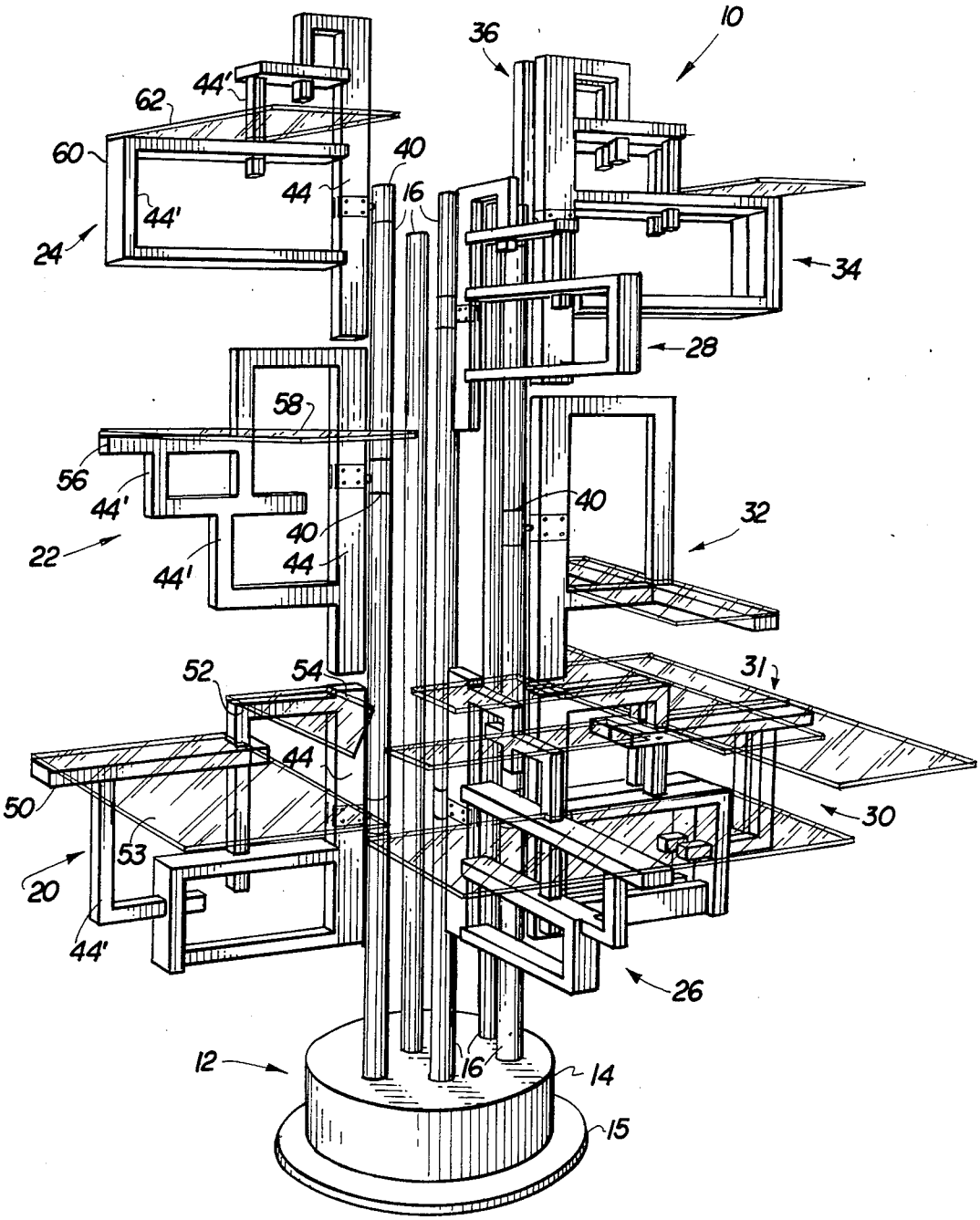
FIG. 1 is a perspective view of the furniture assembly of the present invention.

While the embodiment of the furniture assembly 10 in FIG. 1 is represented as having a plurality of spaced apart stanchions 16, it should be emphasized that the furniture assembly as schematically represented in FIGS. 1A through 1D shows but a single stanchion 16 having at least one support platform 19 with a panel member 23 defining a horizontal surface thereon. Accordingly, the present invention is meant to contemplate the furniture assembly 10' having at least 1 stanchion 16 with at least one platform 19 pivotaly mounted so as to be selectively rotatable about the longitudinal axis of the stanchion 16 and further wherein the panel member 23 is selectively positionable by pivotal rotation about the longitudinal axis of the one stanchion 16 into a variety of positions restricted only possibly by the existence of wall surfaces or other interruptive objects. A further review of FIGS. 1A, 1B, 1C and 1D indicates the versatility not only of the furniture assembly 10', but more specifically of the ability to utilize the space in which the furniture assembly 10 or 10' is positioned in a more versatile manner.

Figure 1A:
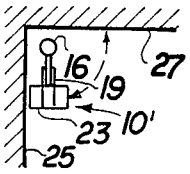
FIG. 1A is a schematic representation of the selective displacement of the furniture assembly when positioned in a corner.
Figure 1B:
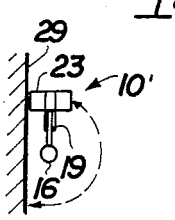
FIG. 1B is a schematic representation of the furniture assembly of the present invention being capable of selective rotation through 180 degrees, for example, when it is located against a flat wall.
Figure 1C:
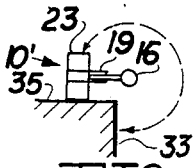
FIG. 1C is a schematic representation of the furniture assembly of the present invention capable of being rotated through 270 degrees, for example, when it is positioned on the exterior of a corner.
Figure 1D:
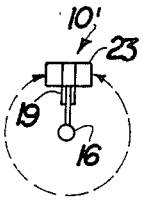
FIG. 1D is a schematic representation of the furniture assembly of the present invention being selectively positionable through 360 degrees of rotation as when the furniture assembly is located in an open space unobstructed by any wall surface.
Figure 2:
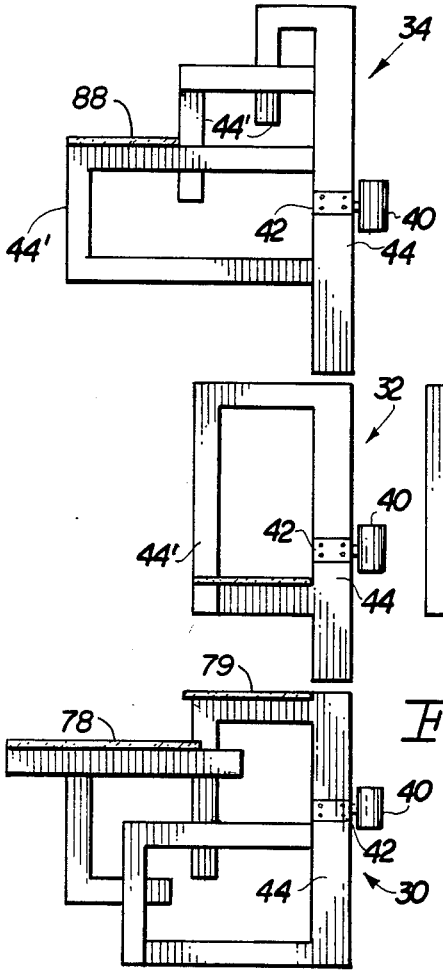
FIG. 2 is a side elevation of a plurality of support platforms and there relation to one another.
Figure 3:
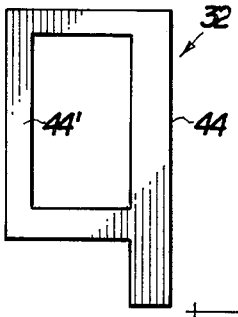
FIG. 3 is a side plan view in detail of one support structure.
Figure 4:
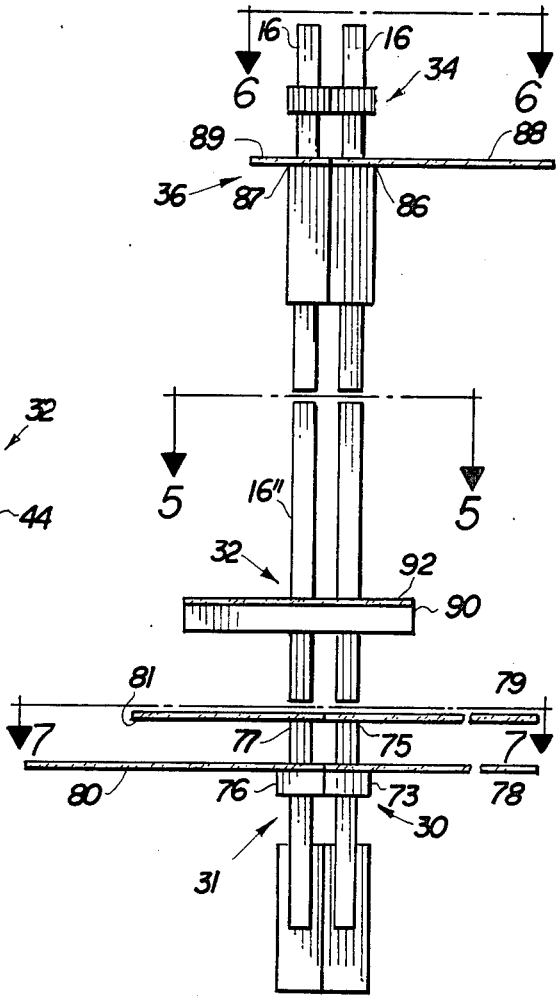
FIG. 4 is a front elevation of a plurality of support platforms and support panels mounted on adjacent stanchions of the base structure of the present invention.
Figure 5:
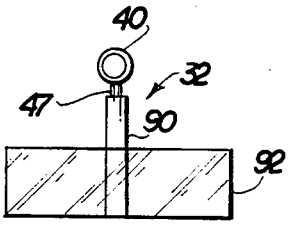
FIG. 5 is a top plan view along line 5—5 of FIG. 4.
Figure 6:
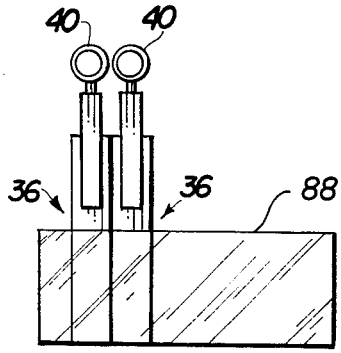
FIG. 6 is a top plan view along line 6—6 of FIG. 4.
Figure 7:
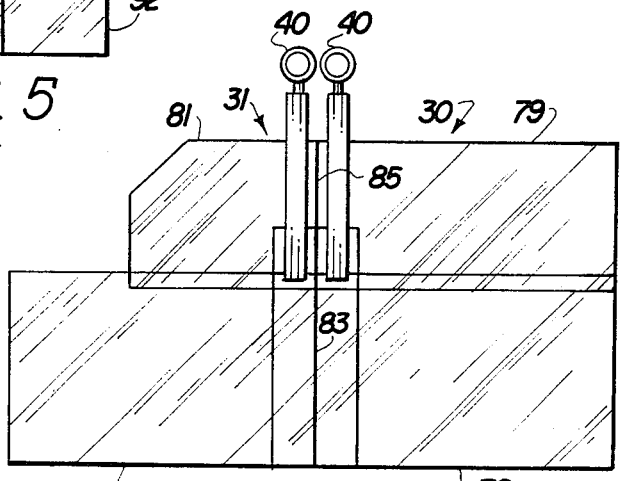
FIG. 7 is a top plan view along line 7—7 of FIG. 4.
Figure 8:
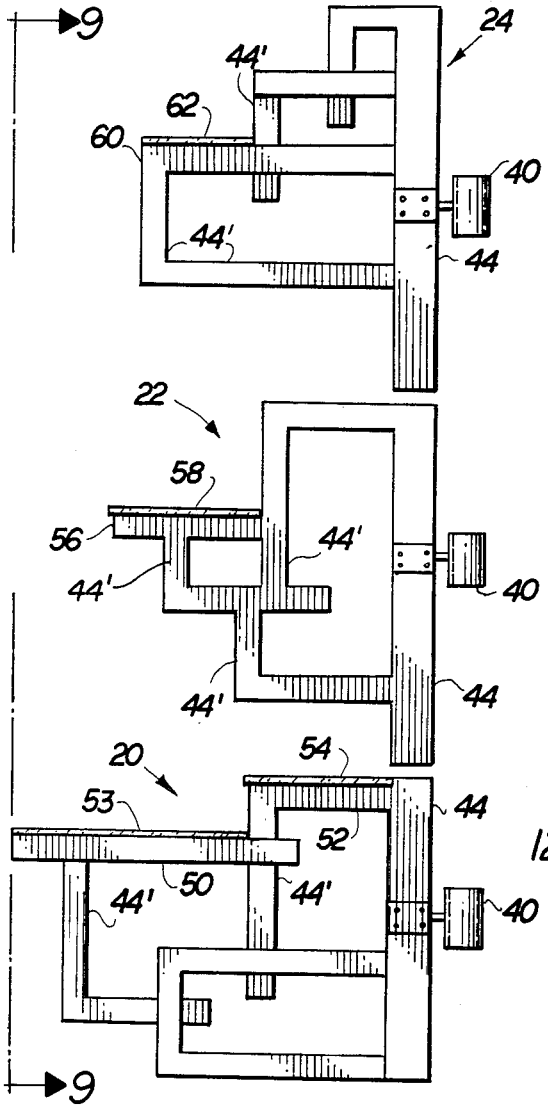
FIG. 8 is an enlarged detailed view similar to the embodiment of FIG. 2.
Figure 9:
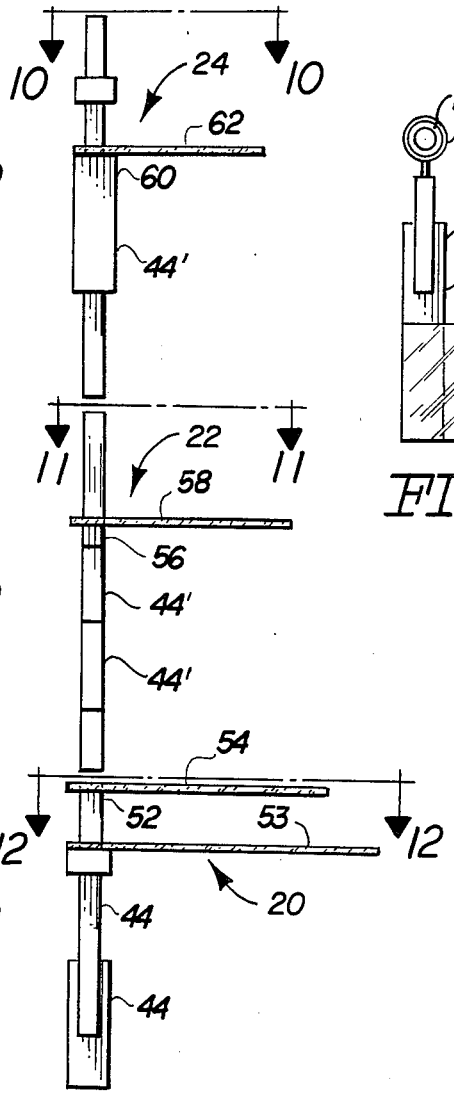
FIG. 9 is a front elevation along line 9—9 of FIG. 8.
Figure 10:
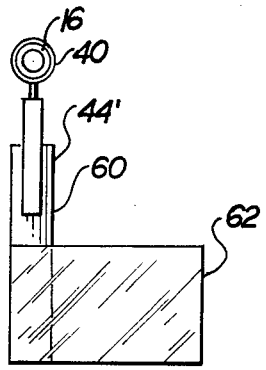
FIG. 10 is a top plan view along line 10—10 of FIG. 9.
Figure 11:
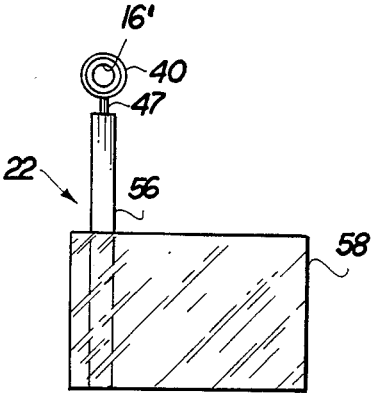
FIG. 11 is a top plan view along line 11—11 of FIG. 9.
Figure 12:
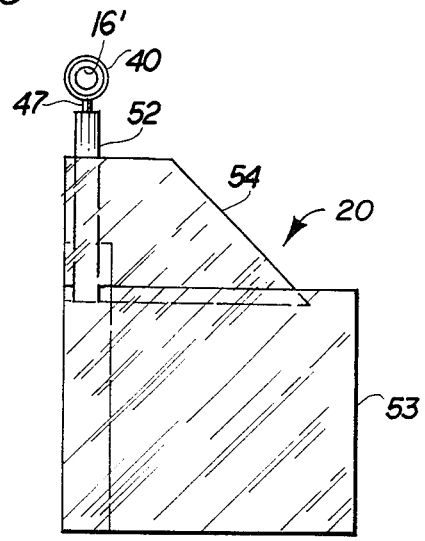
FIG. 12 is a top plan view along line 12—12 of FIG. 9.
Figure 13:
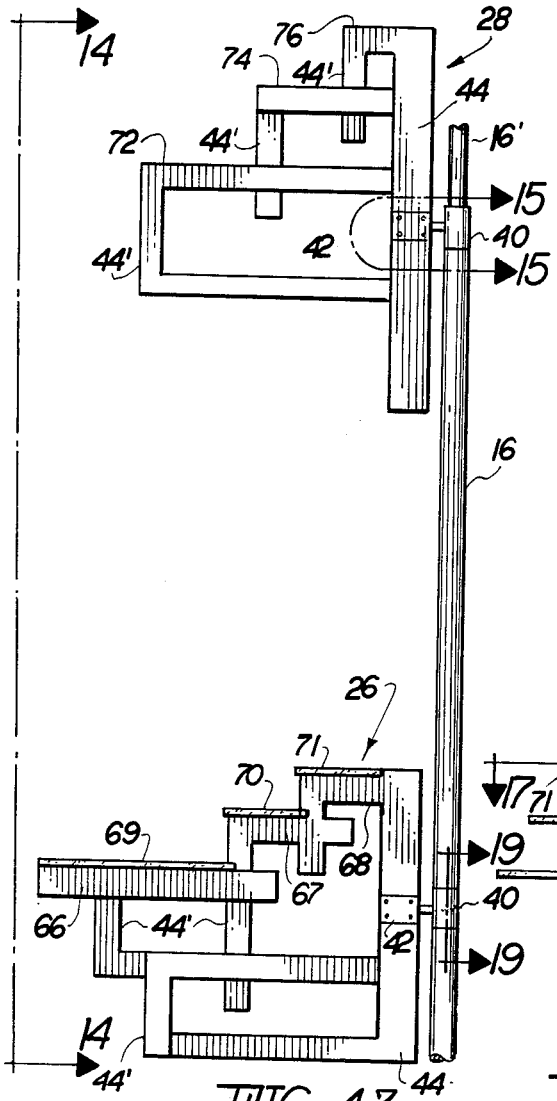
FIG. 13 is a side view in partial cutaway of two support platforms mounted on a common stanchion.
Figure 14:
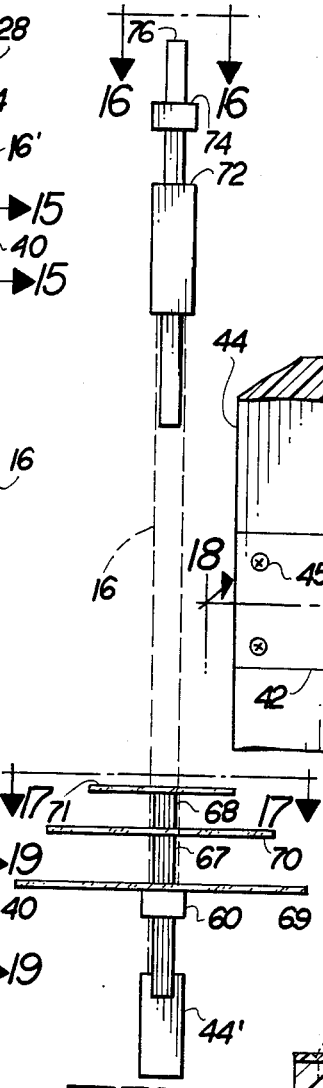
FIG. 14 is a front view along line 14—14 of FIG. 13 with the supporting stanchion represented in phantom lines.
Figure 15:
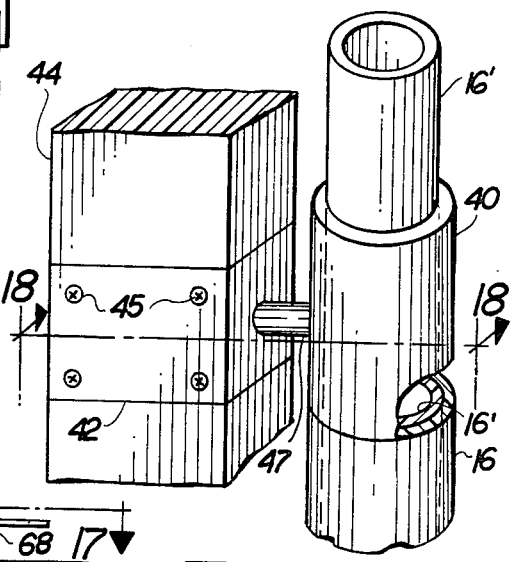
FIG. 15 is a detailed view in partial cutaway in section along line 15—15 of FIG. 13.
Figure 18:
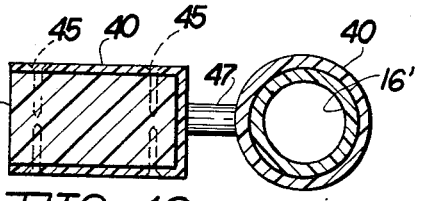
FIG. 18 is a sectional view along line 18—18 of FIG. 15.
Figure 16:
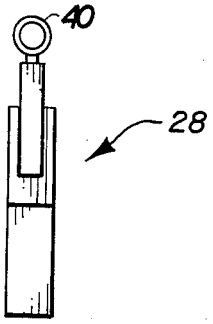
FIG. 16 is a top plan view along line 16—16 of FIG. 14.
Figure 17:
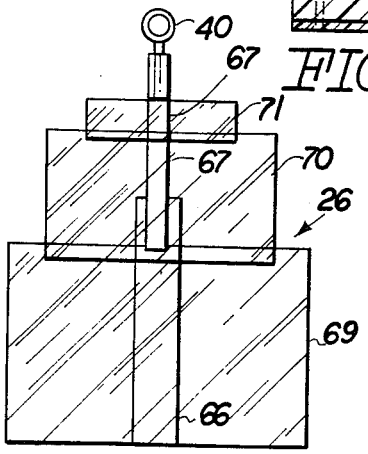
FIG. 17 is a top plan view along line 17—17 of FIG. 14.
Figure 19:
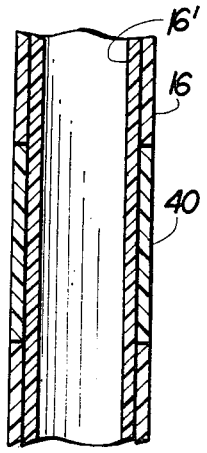
FIG. 19 is a sectional view along line 19—19 of FIG. 13.
Figure 20:
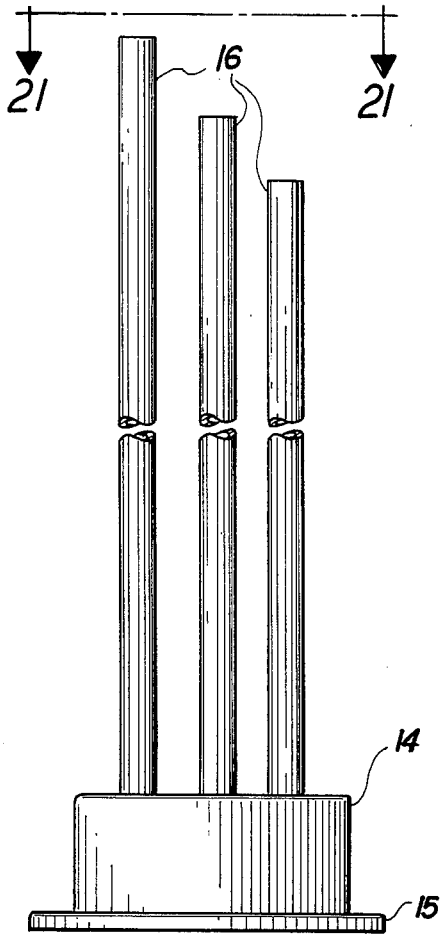
FIG. 20 is a front elevation in partial cutaway of the base structure of the present invention.
Figure 21:
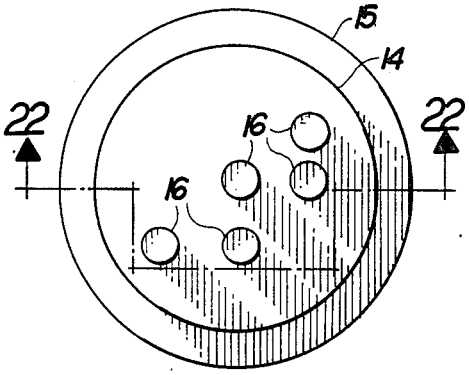
FIG. 21 is a top plan view along line 21—21 of FIG. 20.

With regard to FIG. 1A, the furniture assembly 10' is indicated as being selectively positionable between oppositely positioned wall surfaces 25 and 27 joined together to form a right angled corner. Accordingly, the arc of at least 90 degrees and through a maximum arc of substantially 360 degrees.

5. An assembly as in claim 1 wherein each of said support arms are mounted in supporting relation to an undersurface of a respective one of said panel members and dimensioned to extend continuously along an entire transverse dimension thereof.

6. An assembly as in claim 5 wherein at least some of said panel members extend outwardly from said undersurface mounting in cantilevered fashion.

7. An assembly as in claim 1 wherein said brace means comprises a plurality of substantially coplanar brace members fixedly secured to and interconnecting said respective support arm to the remainder of the respective one of said support platforms and extending outwardly in a common direction relative to a respective stanchion.

8. An assembly as in claim 7 wherein said plurality of brace members are fixedly mounted relative to one another and normally mounted in substantially coplanar relation to a respective one of said support arms.

* * * * *

United States Patent [19]

Przewalski

[11] Patent Number: 4,763,583

[45] Date of Patent: Aug. 16, 1988

[54] SELF-SUSTAINING WET WASTE INCINERATOR

[75] Inventor: Zygmunt J. Przewalski, Granby, Conn.

[73] Assignee: M & S Engineering & Manufacturing Co., Inc., Broad Brook, Conn.

[21] Appl. No.: 1,666

[22] Filed: Jan. 9, 1987

[51] Int. Cl.[4] ..... A47J 36/00; A47J 36/24

[52] U.S. Cl. ..... 110/246; 110/211; 110/212; 110/214

[58] Field of Search ..... 110/212, 213, 214, 246, 110/346, 226

[56] References Cited

U.S. PATENT DOCUMENTS

| | | | |
|---|---|---|---|
| 3,776,148 | 12/1973 | Hapgood et al. | 110/212 X |
| 4,037,543 | 7/1977 | Angelo | 110/214 |
| 4,254,715 | 3/1981 | Lahaye et al. | 110/214 X |
| 4,350,102 | 9/1982 | Ruegg | 110/246 |

FOREIGN PATENT DOCUMENTS

| | | | |
|---|---|---|---|
| 2435878 | 2/1975 | Fed. Rep. of Germany | 110/212 |

*Primary Examiner*—Edward G. Favors

*Attorney, Agent, or Firm*—Hayes & Reinsmith

[57] ABSTRACT

An apparatus for combusting wet waste or the like comprising ignition means including an ignition chamber having an inlet passageway extending therefrom for introducing the waste, an ignition burner for heating the waste to form non-combustible solids and at least partially combustible flue gases, a first outlet for the flue gases in the wall of the inlet passageway, and a second outlet for the solids; combustion means for substantially combusting the flue gases including a combustion passageway wrapped around the inlet passageway from the ignition chamber first outlet to a combustion chamber, and a combustion burner in the combustion passageway adjacent to the first outlet for aspirating and heating the flue gases; heat recuperating means for transferring heat from the substantially combusted flue gases to preheat an oxygen-containing gas; and passageway means for transferring the pre-heated oxygen-containing gas from the recuperator to the ignition burner and the combustion burner. Also, a method of combusting wet waste comprising the steps of heating the wet waste in an ignition means to partially combust the waste and form non-combustible solids and at least partially combustible flue gases; drawing the flue gases from the ignition means into a combustion means; heating the flue gases in the combustion means to substantially combust the gases; transferring a portion of the heat from the combusted flue gases to an oxygen-containing gas; and injecting the heated oxygen-containing gas into the ignition means and the combustion means to provide the heating therein.

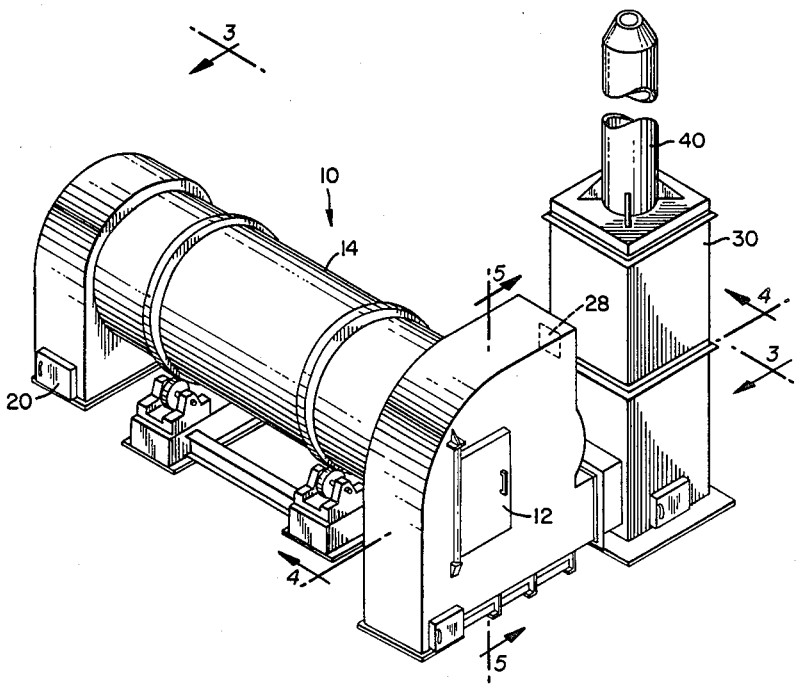

3 Claims, 5 Drawing Sheets